US008985434B2

(12) United States Patent
Djoudi

(10) Patent No.: US 8,985,434 B2
(45) Date of Patent: Mar. 24, 2015

(54) BALLOT BOX FOR COLLECTING BALLOT ENVELOPES AND COMPRISING A MEANS FOR CHECKING THE PHYSICAL ACCEPTABILITY OF EACH BALLOT ENVELOPE

(76) Inventor: Abdelhakim Djoudi, Saint Gely Du Fesc (FR)

( * ) Notice: Subject to any disclaimer, the term of this patent is extended or adjusted under 35 U.S.C. 154(b) by 0 days.

(21) Appl. No.: 14/122,429

(22) PCT Filed: May 31, 2012

(86) PCT No.: PCT/FR2012/051215

§ 371 (c)(1),
(2), (4) Date: Jan. 8, 2014

(87) PCT Pub. No.: WO2012/164225

PCT Pub. Date: Dec. 6, 2012

(65) Prior Publication Data

US 2014/0110467 A1 Apr. 24, 2014

(30) Foreign Application Priority Data

Jun. 1, 2011 (FR) ..... 11 01705

(51) Int. Cl.
*G07C 13/02* (2006.01)

(52) U.S. Cl.
CPC ..... *G07C 13/02* (2013.01)
USPC ..... 232/2

(58) Field of Classification Search
USPC ..... 232/2, 44; 235/51, 57, 386; 340/5.86, 340/674; 271/262, 263, 265.04
See application file for complete search history.

(56) References Cited

U.S. PATENT DOCUMENTS

| | | | | |
|---|---|---|---|---|
| 3,176,981 | A * | 4/1965 | Vandeman | 271/263 |
| 4,605,926 | A | 8/1986 | Onishi et al. | |
| 4,937,460 | A * | 6/1990 | Duncan et al. | 250/559.27 |
| 4,998,998 | A * | 3/1991 | Shigetoshi et al. | 271/263 |
| 5,577,720 | A * | 11/1996 | Laskowski | 271/265.04 |
| 6,824,043 | B2 * | 11/2004 | Navarro Jimenez | 232/2 |
| 7,025,348 | B2 * | 4/2006 | Phinney et al. | 271/262 |
| 7,404,559 | B2 * | 7/2008 | Yoshimura et al. | 271/263 |

(Continued)

FOREIGN PATENT DOCUMENTS

| | | |
|---|---|---|
| FR | 2 922 346 | 4/2009 |
| WO | 2010/055390 | 5/2010 |

OTHER PUBLICATIONS

International Search Report dated Sep. 5, 2012, corresponding PCT/FR2012/051215.

*Primary Examiner* — William Miller
(74) *Attorney, Agent, or Firm* — Young & Thompson

(57) ABSTRACT

A ballot box for collecting ballot envelopes, includes a horizontal bottom wall, vertical walls attached to the bottom wall, and a horizontal top wall forming a lid that is provided with an opening for inserting a ballot envelope into the inner space. The insertion opening forms a vertical guiding passage having a rectangular cross-section delimited by two large parallel surfaces and two side surfaces, the opening including a hatch actuated by a motor, wherein the hatch can assume a position for blocking the opening or a released position. The box includes an element for checking one of the physical parameters of the ballot envelope, which is capable of controlling the motor of the hatch in order to clear the opening if the envelope is acceptable, or to otherwise block the opening, the checking element including a monitoring and control unit (4) to which the motor is connected.

7 Claims, 5 Drawing Sheets

(56) References Cited

U.S. PATENT DOCUMENTS 8,038,053 B2 * 10/2011 Kapsis ..... 235/51
8,096,471 B2 * 1/2012 Cummings et al. ..... 235/386
8,413,880 B2 * 4/2013 Kapsis ..... 235/51

* cited by examiner

BALLOT BOX FOR COLLECTING BALLOT ENVELOPES AND COMPRISING A MEANS FOR CHECKING THE PHYSICAL ACCEPTABILITY OF EACH BALLOT ENVELOPE

TECHNICAL FIELD

This invention is of the field of materials used during an election and relates more particularly to a ballot box equipped with means for checking the physical acceptability of each ballot envelope, namely of the envelope and its contents.

PRIOR ART

It is not infrequent that during a voting process, elements other than acceptable ballots, such as hard objects, metal foil, cardboard and the like, are introduced into the envelope. Such elements are likely to disturb the efficient progress of the analysis and thereby to delay the results.

DISCLOSURE OF THE INVENTION

This invention has as its object to bring a solution to the above-mentioned problem by proposing a voting ballot box that incorporates a means for checking the physical acceptability of the ballot envelope.

For this purpose, the ballot box for collecting ballot envelopes that are each made of an envelope and a voting ballot inserted into the envelope—said ballot box comprising a horizontal bottom wall, vertical walls fastened to the bottom wall and a horizontal top wall forming a lid, which is provided with an opening for inserting a ballot envelope into the internal space of said ballot box—is characterized essentially in that the insertion opening forms a vertical guiding passage having a rectangular cross-section, delimited by two large parallel surfaces and two side surfaces, said opening comprising a motorized trap door that can occupy a position of obstructing said opening or a position of disengagement and in that said ballot box comprises a means for checking one of the physical parameters of the ballot envelope that is able to control the motor of the trap door in order to clear the opening if the envelope is acceptable or to prevent the opening in the opposite case.

According to another characteristic of the invention, the parameter measured is weight.

According to another characteristic of the invention, the parameter measured is the degree of opaqueness.

According to another characteristic of the invention, the parameter measured is the thickness of the ballot envelope.

SUMMARY DESCRIPTION OF THE FIGURES AND DRAWINGS

Other advantages, objects and characteristics of the invention will appear upon reading the description of a preferred embodiment given by way of nonlimiting example while referring to the accompanying drawings in which.

BEST WAYS TO IMPLEMENT THE INVENTION

Figure 1:
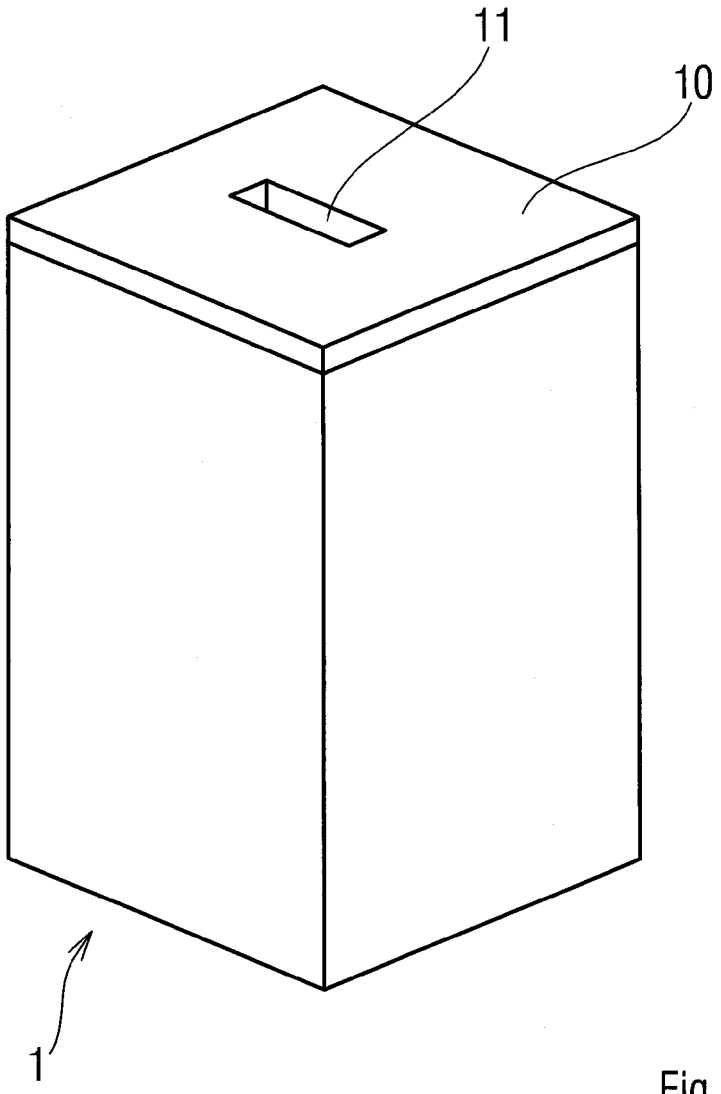
FIG. 1 is a perspective view of a ballot box according to the invention.

In FIG. 1, a ballot box 1 according to the invention is shown diagrammatically. This ballot box, with a parallelepiped shape, comprises a horizontal bottom wall on which four vertical walls are erected and fastened, namely a front wall, a rear wall and two side walls. The ballot box is also equipped with a horizontal top wall 10 that forms a lid, resting on the upper portion of each of the front, rear and side walls, this top wall being fastened in a removable way to these various vertical walls.

The top wall 10, for example in its center, has a passage 11 for insertion, into the internal space of the ballot box, of the ballot envelopes P.

According to the invention, the passage 11 forms a vertical guiding passage having a rectangular cross-section, delimited by two large parallel surfaces and two side surfaces of lesser width than that of the large surfaces. This passage 11 at the lower end has a radial opening 12 for passage of a trap door 2 driven by an electric motor element 26, which can occupy, under the action of the motor element 26, either a position of obstructing the passage 11, or a position of disengagement from this passage. Also, the ballot box, according to the invention, comprises a means for checking at least one of the physical parameters of the ballot envelope P, which can control the motor of the trap door to clear the passage if the envelope P is acceptable to pre-established criteria or to hold the passage 11 in a state of closure in the opposite case. The ballot envelope P is inserted into the passage 11 and is first blocked in this passage. If the ballot envelope, after checking, is considered acceptable, the passage 11 is cleared so that the ballot envelope P, under its own weight, can fall into the internal space of the ballot box. In the opposite case, the trap door 2 is held in a state of closure and the anomaly found is signaled by a sound or light signal.

According to the preferred embodiment, the checking means comprises a sensor that is sensitive to at least one of the physical parameters of the ballot envelope and can produce an electric signal that is representative of the value of this parameter, and a central processing command and control unit 4, structured, for example, around a microprocessor, to which both the sensor and the motor element 26 of the trap door are connected. Additionally, the passage 11, above and away from the trap door 2, will have a device 13 for detecting the presence of the ballot envelope. This detector will be connected electrically to the command and control unit 4. This detector 13 will have an element that emits a light beam and an element that receives this beam. These elements will be able to be placed opposite one another on both sides of the path of the ballot envelope in the passage. This detector 13 functions by detecting the cutting of a light beam. Alternatively, the two emitting and receiving elements are placed side by side, the receiver being able then to detect the beam reflected by the ballot envelope.

Figure 2:
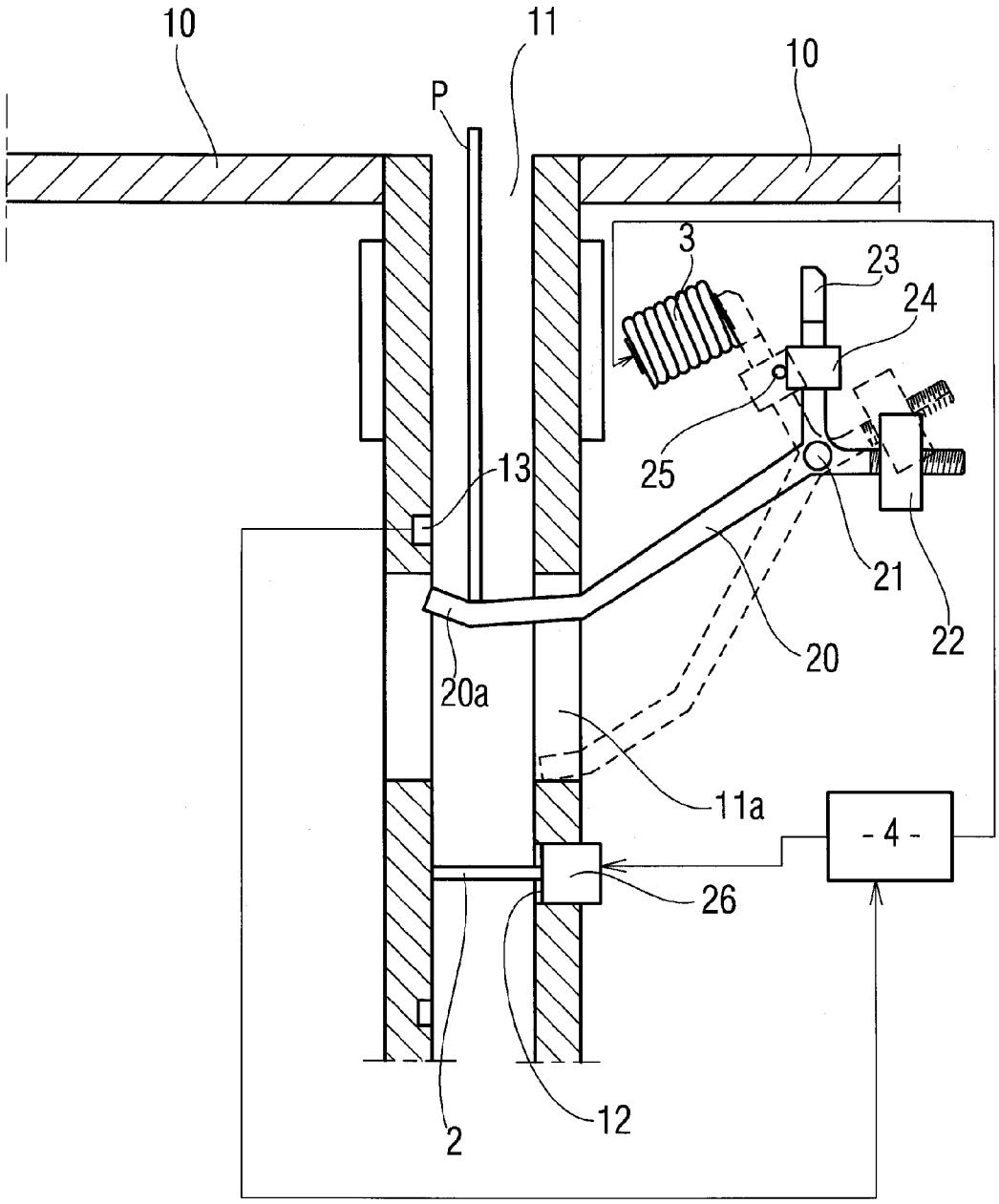
FIG. 2 is a cutaway view of a ballot box according to a first embodiment.

In FIG. 2, a ballot box according to a first embodiment is shown, with the parameter considered being the weight of the envelope.

According to the embodiment that is the object of this FIG. 2, the passage 11 above the trap door 2 and below the detector 13 has a radial opening 11*a*, and the weight detector comprises, above and away from the trap door 2, a paddle blade 20 *a* that can be engaged in the passage 11 by passing through the radial opening 11*a*. This paddle blade 20 *a*, designed to receive and support the ballot envelope P for the purpose of weighing, is carried by a pivoting arm 20 that is hinged away from said passage 11 with a horizontal pin 21 carried by, for example, a clevis, not shown, fastened to the structure of the guiding passage. Thus, this paddle blade 20 *a*, by pivoting the arm 20, is placed either in a position of obstructing the passage 11, in which it is crosswise to the latter and opposes the advance of the ballot envelope P, or else in a position of clearing this passage 11, in which it is sidewise to the latter. The arm 20 works with a balancing element that pulls it to the position of obstructing the passage 11. The balancing element is formed either by an elastic element of the spiral spring type or, according to the preferred embodiment, by a counterweight 22. For this purpose, the arm 20 is extended beyond the hinge pin 21 and receives at this level the counterweight 22, the latter being fitted on the arm. Advantageously, the distance between the hinge pin and the center of mass of the counterweight is adjustable. In this connection, the counterweight can be equipped with a set screw tightened on the arm, or else the part of the arm located beyond the hinge pin can be threaded and can work by screwing with a through tapping formed in the counterweight 22.

The arm 20 is driven while pivoting toward the position of clearing the passage by a motor element 3 installed permanently inside the ballot box and controlled by the command and control unit 4 to which it is connected. According to the preferred embodiment, the arm 20 has a radial extension 23 with which the motor element 3 works. This motor element 3, by action on this extension 23, forces the pivoting of the arm toward the position of clearing the passage 11. According to an embodiment, this radial extension 23 is made of ferromagnetic material, and the motor element 3 is an electromagnet formed by an electric coil and a core made of ferromagnetic material that can, when an electric current is passed through the coil, generate a magnetic field under the effect of which the radial extension of the arm is drawn toward the core and the arm to pivot and the paddle blade 20 *a* to be disengaged from the passage 11.

Finally, the arm 20 carries an obstructing device 24 that can move, by pivoting the arm, opposite or toward an optical sensor 25 connected to the command and control unit 4. This optical sensor 25 can be of the beam-cutting type and will consist of an element that emits a light beam and an element that receives this beam. The obstructing device is brought opposite the optical sensor 25 when the ballot envelope has a weight that is too great to be acceptable.

The functioning of this first embodiment is as follows: when a ballot envelope P is detected in the passage 11 by the detector 13 and this without the beam emitted by the sensor 25 being cut, the motor element 3 is activated by the command and control unit 4 so that the paddle blade 20 *a*, by pivoting the arm 20, is disengaged from the passage 11. The motor element 26 is also activated by the command and control unit 4 so that the trap door 2 is placed in its position of clearing the passage 11, as explained earlier. However, when the weight of the ballot envelope P is too great, the arm 20 under the effect of this weight is displaced by an angular value such that the obstructing device 24 is then positioned opposite the emitter that has the optical sensor 25 and blacks out the latter. Under these conditions, the motor 26 will not be activated by the command and control unit 4, and a default signal will be emitted by the latter.

In the arrangement as described, the checking means functions as all or nothing. According to another arrangement of the invention, there is associated—with the arm 20 or with one of the elements connected to the latter—a potentiometric sensor or the equivalent, connected to the command and control unit 4, which can deliver to the latter a signal that is representative of the angular position of the arm relative to an original position and as a result representative of the weight value of the ballot envelope. According to this embodiment, the arm will be returned to its original position by an elastic element known in the art. Still according to this embodiment, the command and control unit 4 compares the value of the signal received to a value or a range of values entered in memory, and if the value by weight of the ballot envelope is acceptable, it activates the motor elements 3 and 26 to clear the passage 11. In the opposite case, these motor elements are kept deactivated by the command and control unit 4 so that the ballot envelope P cannot be inserted into the ballot box. Under this condition, a default signal is emitted by the command and control unit 4.

Figure 3:
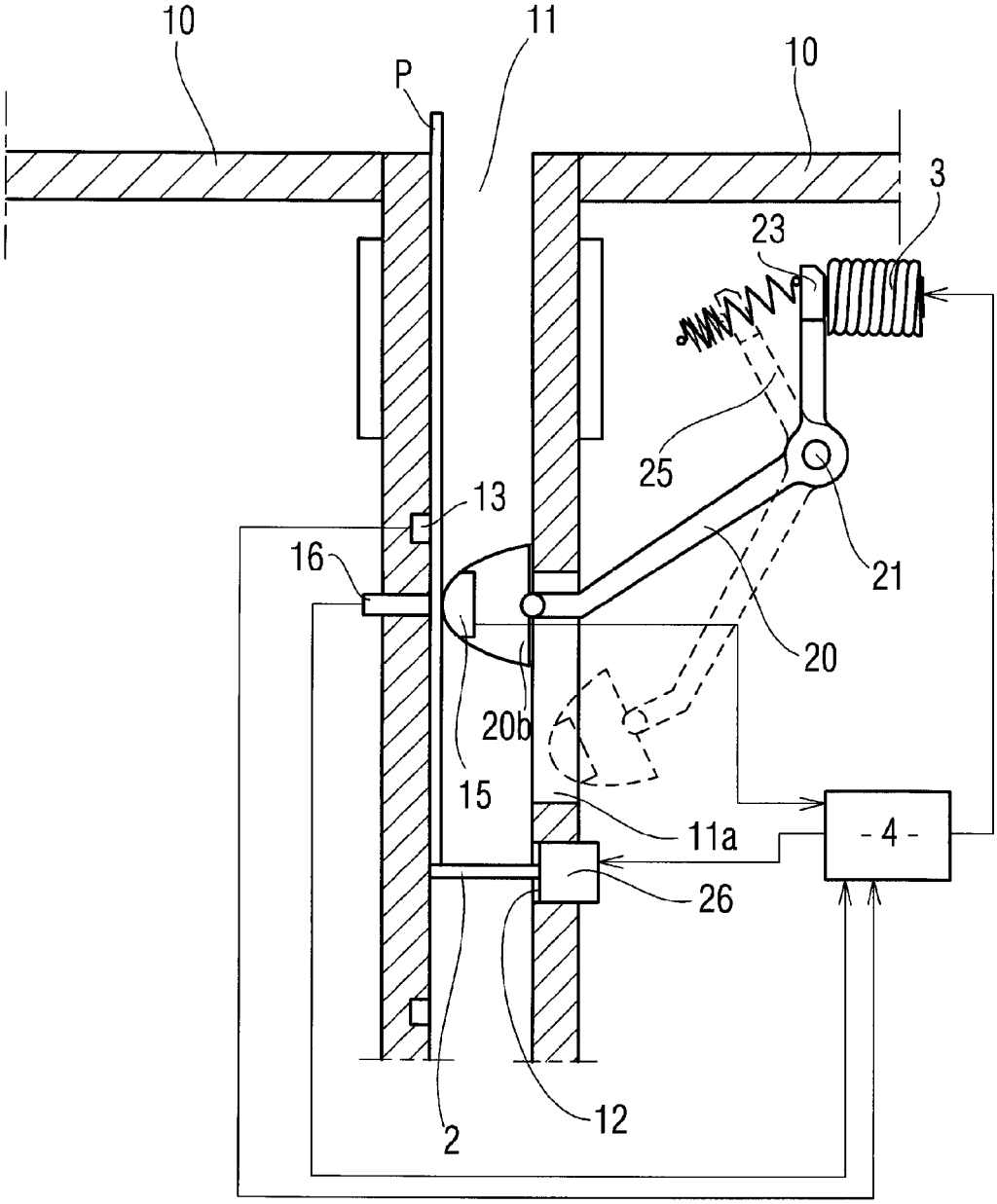
FIG. 3 is a cutaway view of a ballot box according to a second embodiment.

In FIG. 3, a second embodiment of the ballot box according to the invention is shown. According to this embodiment, the checked parameter is the degree of opaqueness, and the passage 11 above the trap door 2 and below the detector 13 is equipped, on the one hand, with a light emitter 15 in the form of a light-emitting diode, for example, and, on the other hand, with a receiver 16 in the form of a phototransistor that is sensitive to the light emitted by the emitter 15. The emitter defines a light path that is perpendicular to the two large surfaces of the passage.

According to this embodiment, the receiver 16 is associated electrically with the command and control unit 4, which is able to compare the value delivered by the receiver to a value entered in memory and, if the value measured is compatible with the value entered in memory, is able to act on the motor 26 of the trap door 2 so that the latter is driven in the direction of the opening of the passage.

In a practical embodiment, a radial opening 11*a* is made in the passage 11 above the trap door 2 and below the detector 13, and one of the elements—emitter 15 or receiver 16—is fastened to the passage and the other is carried by a tip 20*b* mounted at the end of a hinged arm 20 that is mobile between a waiting position in which the tip 20*b* is outside of the passage and a measuring position in which the tip is inserted radially into the passage 11 by passing through the radial opening 11*a*. In this position, the tip 20*b* applies the ballot envelope against the opposite surface of the passage. The ballot envelope therefore is sandwiched between the emitter 15 and the receiver 16. Still in this practical embodiment, the arm 20 is equipped with a return element to be pulled to its waiting position and is driven to the measuring position by a motor element 3 installed permanently inside the ballot box and connected to the command and control unit 4 to be controlled by the latter. In the practical embodiment, the arm 20 is equipped with a radial extension 23 made of ferromagnetic material, and the motor element 3 consists of an electromagnet that can act magnetically on the radial extension to attract it and to force the pivoting of the arm to the measuring position.

The functioning of this embodiment is as follows: an envelope P inserted into the passage 11 is stopped in its advance toward the internal space of the ballot box by the trap door 2, the latter being in a position of obstructing the passage 11. The presence in the passage of the ballot envelope P is detected by the detector 13, and the command and control unit 4 then activates the motor element 3 so that the arm 20 and the tip 20*b* that it carries are brought into measuring position. The measurement performed, the motor 3 will be deactivated so that the arm 20 under the action of the return element is brought back into waiting position. After measurement and comparison of the result to the values entered in memory, the motor 26 will be activated and the trap door 2 opened if the envelope P is acceptable or will stay deactivated in the opposite case. A default signal can then be emitted by the command and control unit 4.

Figure 4:
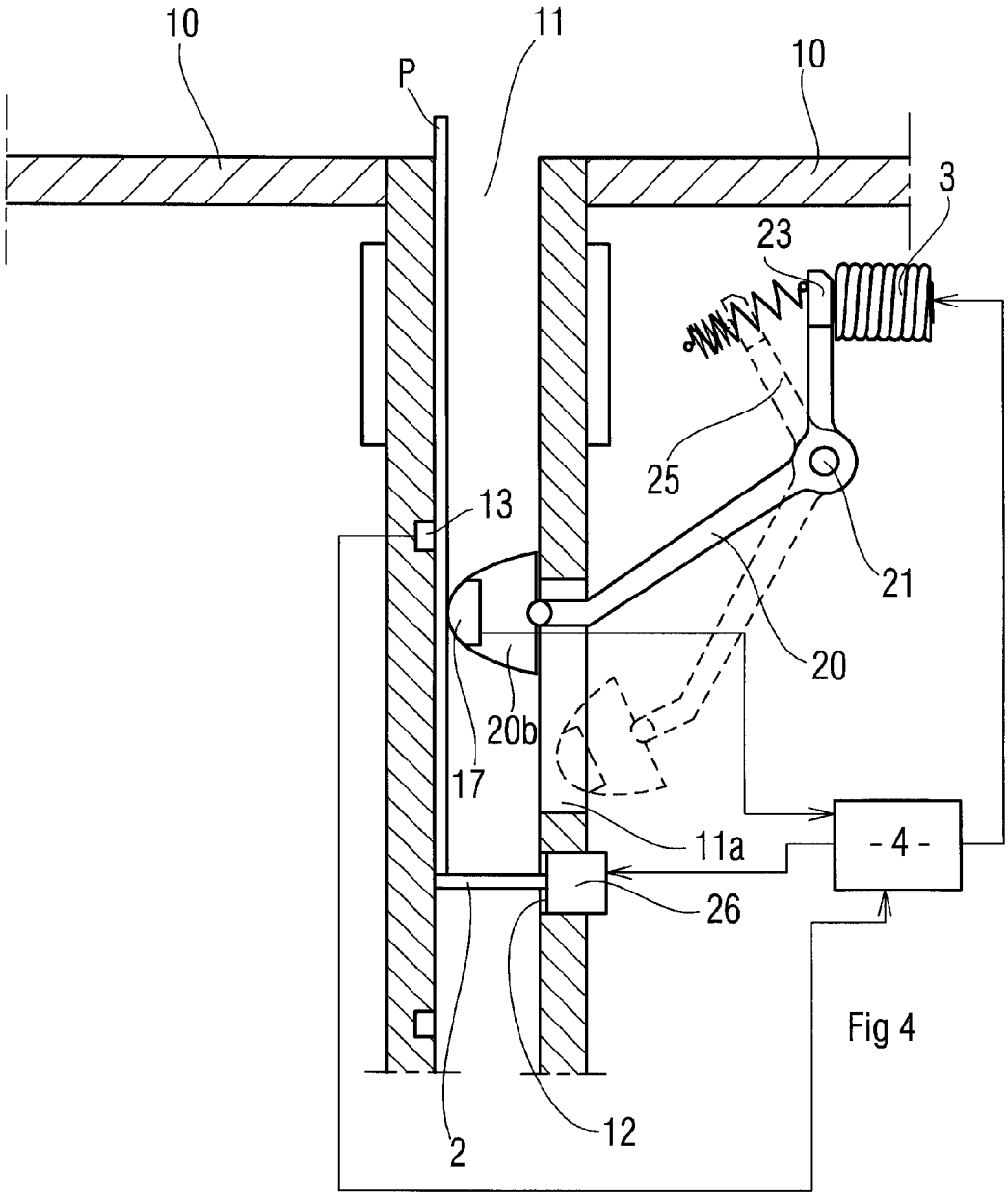
FIG. 4 is a cutaway view of a ballot box according to a third embodiment of the invention.

In FIG. 4, a third embodiment of the ballot box according to the invention is shown. According to this embodiment, the parameter checked is the thickness of the ballot envelope P, and the passage 11 above the trap door 2 and below the detector 13 receives an ultrasonic sensor 17 connected electrically to the command and control unit 4, the latter being able to compare the value of the signal delivered by the ultrasonic sensor, which is representative of the thickness of the envelope P, to a value entered in memory and, if the value measured is compatible with the value entered in memory, to act on the motor 26 of the trap door so that the latter is driven in the direction of the opening of the passage 11.

In the practical embodiment, a radial opening 11*a* is made in the passage 11, above the trap door 2 and below the detector 13, and the ultrasonic sensor 17 is carried by a tip 20*b* mounted at the end of a hinged arm 20, which is mobile between a waiting position in which the tip is outside of the passage 11 and a measuring position in which the tip 20*b* is inserted radially into the passage 11 by passing through the radial opening 11*a*. In this position, the tip 20*b* applies, with a calibrated force, the ballot envelope P against the opposite surface of the passage for the purpose of measuring it. Still in this practical embodiment, as before, the arm 20 is equipped with a return element to be pulled to its waiting position, this return element being able to consist of a counterweight or else an elastic element. The arm 20 is driven to the measuring position by a motor element 3 installed permanently in the ballot box, connected to the command and control unit 4 and controlled by the latter. According to a preferred embodiment, the arm 20 is equipped with a radial extension 23 made of ferromagnetic material, and the motor element 3 consists of an electromagnet able to act magnetically on the radial extension to attract it and to move the arm angularly to the measuring position.

The functioning of this embodiment is as follows: an envelope P inserted into the passage 11 is stopped in its advance toward the internal space of the ballot box by the trap door 2, the latter being in a position of obstructing the passage 11. The presence in the passage of the ballot envelope P is detected by the detector 13, and the command and control unit then activates the motor element 3 so that the arm 20 and the tip 20*b* that it carries are brought into measuring position. The measurement performed, the motor 3 will be deactivated so that the arm 20 under the action of the return element is brought back into waiting position. After measurement and comparison of the result to the values entered in memory, the motor 26 will be activated and the trap door 2 opened if the envelope P is acceptable or will stay deactivated in the opposite case. A default signal will then be able to be emitted by the command and control unit 4.

Figure 5:
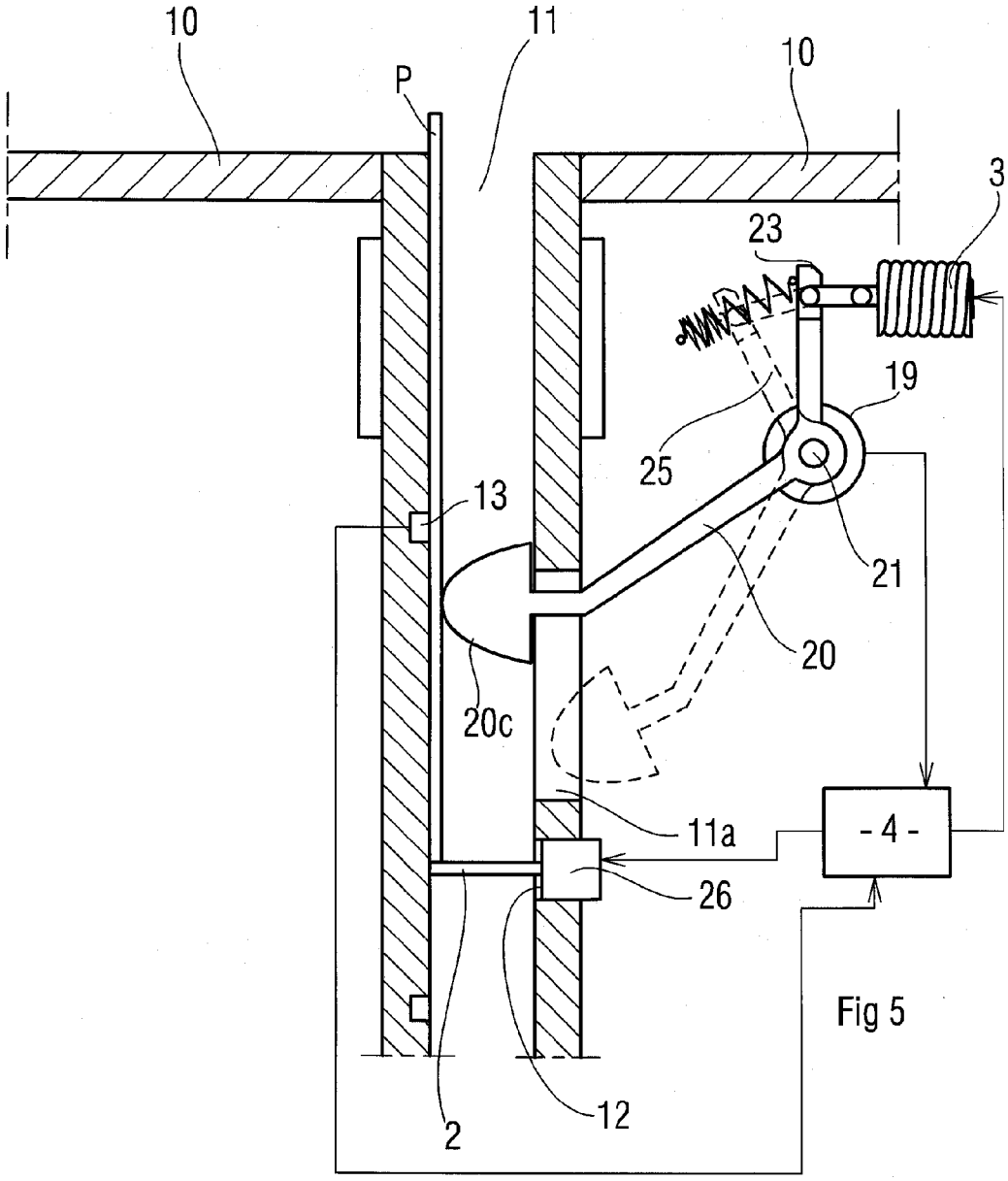
FIG. 5 is a cutaway view of a ballot box according to a fourth embodiment of the invention.

In FIG. 5, a fourth embodiment of the ballot box 1 according to the invention is shown. According to this embodiment, the parameter checked is still the thickness of the ballot envelope P, and the guiding passage 11 is equipped with a mechanical feeler 20*c* associated mechanically with a measuring element 19. This element measures the degree of penetration of the feeler 20*c* in the passage 11, and is connected to the command and control unit 4, which is able to compare the value of the signal delivered by this measuring element 19 to a value entered in memory and if the value measured is compatible with the value entered in memory to act on the motor 26 of the trap door 2 so that the latter is driven in the direction of the opening of the passage 11.

In the practical embodiment, a radial opening 11*a* is made in the passage 11 above the trap door 2 and below the detector 13, and the feeler 20*c* is mounted at the end of a hinged arm 20, which is mobile between a waiting position in which the feeler 20*c* is outside of the passage 11 and a measuring position in which the feeler is inserted radially into the passage 11 by passing through the radial opening 11*a*. In this position, the feeler 20*c* applies, with a calibrated force, the ballot envelope P against the opposite surface of the passage for the purpose of measuring the thickness. Still in this practical embodiment, the arm 20 is equipped with a return element, counterweight or elastic element to be pulled to its waiting position. The arm 20 is driven to the measuring position by a motor element 3 installed permanently in the ballot box, connected to the command and control unit 4 and controlled by the latter. Advantageously, the arm 20 is equipped with a radial extension 23 made of ferromagnetic material and the motor element 3 is an electromagnet able, when it is activated, to act magnetically on the radial extension to attract it and as a result to move the arm 20 to its measuring position.

According to this embodiment, the measuring element 19 is mechanically connected to the arm 20 and is able to produce a signal whose value is representative of the angular position of the arm 20 relative to an original position and consequently of the thickness of the ballot envelope P. Advantageously, this measuring element 19 consists of a potentiometric sensor or the equivalent.

The functioning of this embodiment is as follows: an envelope P inserted into the passage 11 is stopped in its advance toward the internal space of the ballot box by the trap door 2, the latter being in a position of obstructing the passage 11. The presence in the passage of the ballot envelope P is detected by the detector 13, and the command and control unit then activates the motor element 3 so that the arm 20 and the feeler 20*c* that it carries are brought into measuring position. The measurement performed, the motor 3 will be deactivated so that the arm 20 under the action of the return element is brought back into waiting position. After measurement and comparison of the result to the values entered in memory, the motor 26 will be activated and the trap door 2 opened if the envelope P is acceptable or will stay deactivated in the opposite case. A default signal will then be able to be emitted by the command and control unit 4.

Finally, according to the preferred embodiment, the guiding passage 11 extends vertically into the space for receiving the ballot envelopes.

Of course, this invention can receive all modifications and variants of the field of the technical equivalents without thereby going outside the scope of this patent.

The invention claimed is:

1. A ballot box for collecting ballot envelopes, the ballot box comprising:

a horizontal bottom wall;

vertical walls fastened to the horizontal bottom wall;

a horizontal top wall forming a lid, which is provided with a passage configured to receive a ballot envelope into an internal space, the passage forming a vertical guiding passage having a rectangular cross-section, delimited by two large parallel surfaces and two side surfaces, the passage having a trap door received therein, driven by a motor, the trap door configured to move between one of a position of obstructing the passage and a position of disengagement; and means for checking one or more physical parameters of the ballot envelope, the one or more physical parameters including the weight of the ballot envelope, the means for checking being configured to control the motor of the trap door to clear the passage when the ballot envelope is acceptable and to block the passage when the ballot envelope is unacceptable, the checking means comprising a command and control unit, the motor being connected and controlled by the command and control unit, wherein the trap door is disposed at the lower end of the passage, a portion of the passage away from and above the trap door being equipped with a detector configured to detect the presence of the ballot envelope in the passage, the detector being connected to the command and control unit, wherein a radial opening is provided in relation to the passage perpendicular to the direction of entry of the ballot envelope, the radial opening being formed above the trap door and below the detector, wherein the checking means further comprises a weight detector that comprises, above and away from the trap door, a paddle blade configured to be engaged in the passage by passing through the radial opening, said paddle blade being configured to receive and support the ballot envelope for weighing, the paddle blade is carried by a pivoting arm that is hinged away from the passage with a horizontal pin, and by pivoting the arm, the paddle blade occupies a position of clearing the passage, or a position of obstructing the passage, the arm works with a balancing element and is driven while pivoting to the position of clearing the passage by a motor element controlled by the command and control unit.

2. The ballot box according to claim 1, wherein the arm carries an obstructing device that can move by pivoting the arm, opposite or toward an optical sensor connected to the command and control unit so that when the optical sensor is blacked out by the obstructing device, the motor of the trap door cannot be activated by the command and control unit.

3. The ballot box according to claim 1, further comprising a potentiometric sensor associated with the arm or with one of the elements connected to the arm, the potentiometric sensor being connected to the command and control unit that can deliver to the command and control unit a signal that is representative of the angular position of the arm relative to an original position and consequently representative of the weight value of the ballot envelope, the arm being returned to an original position by an elastic element, the command and control unit comparing the value of the received signal to a value or a range of values entered in memory, and as a function of the result of the comparison, activating the motor elements to clear the passage when the weight value of the ballot envelope is acceptable and deactivating the motor elements when the weight value of the ballot envelope is not acceptable.

4. A ballot box for collecting ballot envelopes, the ballot box comprising:

a horizontal bottom wall;

vertical walls fastened to the horizontal bottom wall;

a horizontal top wall forming a lid, which is provided with a passage configured to receive a ballot envelope into an internal space, the passage forming a vertical guiding passage having a rectangular cross-section, delimited by two large parallel surfaces and two side surfaces, the passage having a trap door received therein, driven by a motor, the trap door configured to move between one of a position of obstructing the passage and a position of disengagement;

a detector disposed adjacent the passage and configured to detect the presence of the ballot envelope in the passage; and means for checking one or more physical parameters of the ballot envelope, the one or more physical parameters including the degree of opaqueness of the ballot envelope, the means for checking being configured to control the motor of the trap door to clear the passage when the ballot envelope is acceptable and to block the passage when the ballot envelope is unacceptable, the checking means comprising a command and control unit, the motor being connected and controlled by the command and control unit, the detector being electrically connected to the command and control unit, a light emitter disposed in the passage above the trap door and below the detector, the light emitter defining a light path that is perpendicular to the two large surfaces of the passage, and a receiver disposed in the passage above the trap door and below the detector, the receiver being sensitive to the light emitted by the emitter, the receiver being connected to the command and control unit that is configured to compare a value delivered by the receiver to a value entered in a memory and to act on the motor of the trap door when the delivered value is compatible with the value entered in memory, wherein a radial opening is provided in the passage above the trap door and below the detector, one of the emitter and the receiver is fastened to the passage and the other of the emitter and the receiver is carried by a tip mounted at the end of a hinged arm that is mobile between a waiting position in which the tip is outside of the passage and a measuring position in which the tip is inserted radially into the passage by passing through the radial opening, the arm being equipped with a return element to be pulled to the waiting position and driven to the measuring position by a motor element connected to the command and control unit.

5. The ballot box according to claim 4, wherein the trap door is positioned at the lower end of the passage, a portion of the passage away from and above the trap door being equipped with the detector detecting the presence of the ballot envelope in the passage.

6. The ballot box according to claim 4, wherein the passage extends vertically into the internal space in which the ballot envelope is received.

7. A ballot box for collecting ballot envelopes, the ballot box comprising:

a horizontal bottom wall;

vertical walls fastened to the horizontal bottom wall;

a horizontal top wall forming a lid, which is provided with a passage configured to receive a ballot envelope into an internal space, the passage forming a vertical guiding passage having a rectangular cross-section, delimited by two large parallel surfaces and two side surfaces, the passage having a trap door received therein, driven by a motor, the trap door configured to move between one of a position of obstructing the passage and a position of disengagement;

a detector disposed adjacent the passage and configured to detect the presence of the ballot envelope in the passage; and means for checking one or more physical parameters of the ballot envelope, the one or more physical parameters including the thickness of the ballot envelope, the means for checking being configured to control the motor of the trap door to clear the passage when the ballot envelope is acceptable and to block the passage when the ballot envelope is unacceptable, the checking means comprising a command and control unit, the motor being connected and controlled by the command and control unit, the detector being electrically connected to the command and control unit, and an ultrasonic sensor disposed in the passage above the trap door and below the detector, the ultrasonic sensor being connected electrically to the command and control unit, the command and control unit being configured to compare a value delivered by the ultrasonic sensor to a value entered in memory, and when the delivered value is compatible with the value entered in memory, the command and control unit being configured to act on the motor of the trap door so that the trap door is driven in the direction to open the passage, wherein a radial opening is provided in the passage above the trap door and below the detector, and the ultrasonic sensor is carried by a tip mounted at the end of a hinged arm that is mobile between a waiting position in which the tip is outside of the passage and a measuring position in which the tip is inserted radially into the passage by passing through the radial opening, the arm being equipped with a return element to be pulled to the waiting position and driven to the measuring position by a motor element connected to the command and control unit.

* * * * *